US012435469B2

(12) United States Patent
Lee et al.

(10) Patent No.: US 12,435,469 B2
(45) Date of Patent: Oct. 7, 2025

(54) HIGH YIELD CHEMICAL PULPING AND BLEACHING PROCESS

(71) Applicant: GPCP IP Holdings LLC, Atlanta, GA (US)

(72) Inventors: Jeffrey A. Lee, Neenah, WI (US); Kevin M. Holtman, Appleton, WI (US)

(73) Assignee: GPCP IP Holdings LLC

( * ) Notice: Subject to any disclaimer, the term of this patent is extended or adjusted under 35 U.S.C. 154(b) by 136 days.

(21) Appl. No.: 18/098,490

(22) Filed: Jan. 18, 2023

(65) Prior Publication Data

US 2023/0265609 A1 Aug. 24, 2023

Related U.S. Application Data

(60) Provisional application No. 63/312,419, filed on Feb. 22, 2022.

(51) Int. Cl.

| | |
|---|---|
| ***D21C 9/10*** | (2006.01) |
| ***D21B 1/02*** | (2006.01) |
| ***D21C 3/02*** | (2006.01) |
| ***D21C 9/16*** | (2006.01) |
| *D21H 11/02* | (2006.01) |

(52) U.S. Cl.

CPC ..... *D21B 1/026* (2013.01); *D21C 3/026* (2013.01); *D21C 9/1005* (2013.01); *D21C 9/1068* (2013.01); *D21C 9/163* (2013.01); *D21H 11/02* (2013.01)

(58) Field of Classification Search

CPC ..... D21C 3/026; D21C 9/1068; D21C 9/163; D21C 9/147; D21C 9/15

See application file for complete search history.

(56) References Cited

U.S. PATENT DOCUMENTS

| | | | | | |
|---|---|---|---|---|---|
| 2,514,503 | A | | 7/1950 | Mcewen et al. | |
| 2,692,181 | A | * | 10/1954 | McEwen | D21C 9/163 162/78 |
| 3,462,344 | A | * | 8/1969 | Houg | D21C 9/1036 8/111 |
| 3,655,505 | A | | 4/1972 | Yorston et al. | |
| 3,811,995 | A | | 5/1974 | Ringley | |
| 4,116,758 | A | | 9/1978 | Ford et al. | |
| 4,295,929 | A | | 10/1981 | Leithem | |
| 4,372,811 | A | * | 2/1983 | Samuelson | D21C 9/1036 162/76 |
| 4,372,812 | A | | 2/1983 | Phillips | |
| 4,410,397 | A | * | 10/1983 | Kempf | D21C 9/163 423/273 |
| 4,462,864 | A | * | 7/1984 | Carles | D21C 9/163 162/78 |
| 4,718,980 | A | * | 1/1988 | Lowrie | D21C 9/163 162/28 |
| 4,869,783 | A | | 9/1989 | Prusas | |
| 4,871,423 | A | | 10/1989 | Grimsley et al. | |
| 4,915,785 | A | * | 4/1990 | Siminoski | D21C 9/163 162/78 |
| 4,938,842 | A | | 7/1990 | Whiting et al. | |
| 5,011,572 | A | | 4/1991 | Parthasarathy | |
| 5,143,581 | A | | 9/1992 | Devic | |
| 5,169,495 | A | | 12/1992 | Lachenal | |
| 5,179,021 | A | | 1/1993 | Du et al. | |
| 5,211,809 | A | | 5/1993 | Naddeo | |
| 5,217,575 | A | | 6/1993 | Backlund | |
| 5,486,268 | A | | 1/1996 | Nguyen | |
| 5,503,709 | A | | 4/1996 | Burton | |
| 5,958,179 | A | | 9/1999 | Gehr et al. | |
| 5,997,689 | A | | 12/1999 | Bokstrom | |
| 6,007,678 | A | | 12/1999 | Linsten et al. | |
| 6,027,610 | A | | 2/2000 | Back et al. | |
| 6,059,927 | A | | 5/2000 | Wan | |
| 6,153,300 | A | | 11/2000 | Stromberg et al. | |
| 6,273,994 | B1 | | 8/2001 | Creber et al. | |
| 6,632,328 | B2 | | 10/2003 | Wan | |
| 9,556,558 | B2 | | 1/2017 | Pylkkanen et al. | |
| 10,000,889 | B2 | | 6/2018 | Hart et al. | |
| 10,000,890 | B2 | | 6/2018 | Nonni et al. | |
| 2002/0012912 | A1 | | 1/2002 | Li et al. | |

(Continued)

FOREIGN PATENT DOCUMENTS

| | | | | | |
|---|---|---|---|---|---|
| CA | 1320863 | C | * | 8/1993 | D21B 1/12 |
| CA | 2319223 | A1 | | 3/2002 | |

(Continued)

OTHER PUBLICATIONS

Palenius, High Yield Pulps, 1970, IPPTA, vol. VII, No. 2, pp. 95-98 (Year: 1970).*

Smook, Handbook for Pulp and Paper Technologists, 1992, Angus Wilde Publications, 2nd edition, chapters 9 and 11 (Year: 1992).*

Hart, Production of High Yield Bleached Hardwood Kraft Pulp: Breaking the Kraft Pulp Yield Barrier, Sep. 2011, TAPPI Journal, p. 37-41 (Year: 2011).*

Tao et al., Selectivity of oxygen delignification for southern softwood kraft pulps with high lignin content, 8/20111, TAPPI Journal, p. 29-39 (Year: 2011).*

Non-Final office action received for U.S. Appl. No. 17/548,503, mailed on Nov. 6, 2023, 14 pages.

Final Office action received for U.S. Appl. No. 17/548,503, mailed on May 15, 2024, 11 pages.

(Continued)

*Primary Examiner* — Anthony Calandra

(57) ABSTRACT

A method of producing high yield chemical cellulosic pulp includes: (a) chemically pulping wood chips to separate lignin and liberate cellulosic fibers from the wood chips to generate a cellulosic pulp; (b) washing and screening the pulp of step (a); (c) pre-treating the washed pulp with oxygen; (d) optionally washing the treated pulp of step (c); (e) bleaching the pre-treated pulp in an extended duration oxidative bleaching stage; (f) optionally washing the bleached pulp of step (e); and (g) optionally further oxidatively or reductively bleaching the bleached pulp in a shorter duration bleaching stage, wherein the bleached pulp is produced at a yield of greater than 60% based on the weight of the pulped wood chips (dry basis).

18 Claims, No Drawings

(56) References Cited

U.S. PATENT DOCUMENTS

| | | | |
|---|---|---|---|
| 2002/0129912 | A1 | 9/2002 | Reinhard et al. |
| 2004/0000012 | A1 | 1/2004 | Scarpello |
| 2008/0017337 | A1 | 1/2008 | Duggirala et al. |
| 2008/0087390 | A1 | 4/2008 | Lee |
| 2009/0242152 | A1 | 10/2009 | Vilpponen et al. |
| 2012/0067532 | A1 | 3/2012 | Lee |
| 2013/0203699 | A1 | 8/2013 | Nonni et al. |
| 2021/0079594 | A1 | 3/2021 | Lee |

FOREIGN PATENT DOCUMENTS

| | | | |
|---|---|---|---|
| EP | 0187477 | A1 | 7/1986 |
| EP | 0311356 | A1 | 4/1989 |
| EP | 0480469 | A2 | 4/1992 |
| WO | 9508021 | A1 | 3/1995 |
| WO | 9600322 | A1 | 1/1996 |
| WO | 2021123504 | A1 | 6/2021 |

OTHER PUBLICATIONS

Grace, et al., "Pulp and Paper Manufacture: Alkaline Pulping", The Joint Textbook Committee of the Paper Industry, vol. 5, Third Edition, p. 401, 1989.

International Preliminary Report on Patentability received for PCT Application No. PCT/IB2020/058139, mailed on Feb. 9, 2022, 8 pages.

International Preliminary Report on Patentability received for PCT Application No. PCT/IB2021/062425, mailed on Mar. 28, 2023, 5 pages.

International Search Report and Written Opinion received for PCT Application No. PCT/IB2021/062425, mailed on Mar. 29, 2022, 11 pages.

International Search Report and Written Opinion received for PCT Application No. PCT/IB2020/058139, mailed on Dec. 1, 2020, 12 pages.

Smook, Handbook for Pulp and Paper Technologists, 1992, Angus Wilde Publications, 2nd edition.chapter 1 (Year: 1992), 10 pages.

Written Opinion of International Preliminary Examining Authority received for PCT Application No. PCT/IB2020/058139, mailed on Jun. 18, 2021, 07 Pages.

Non-final office action received for U.S. Appl. No. 17/006,089, mailed on Jun. 14, 2022, 13 pages.

Notice of allowance received for U.S. Appl. No. 17/006,089, mailed on Oct. 26, 2022, 8 pages.

* cited by examiner

HIGH YIELD CHEMICAL PULPING AND BLEACHING PROCESS

CROSS REFERENCE TO RELATED APPLICATION

This application is based on U.S. Provisional Patent Application No. 63/312,419, filed Feb. 22, 2022, the disclosure of which is incorporated by reference in its entirety.

TECHNICAL FIELD

The present invention relates to a high yield process for producing high brightness chemical papermaking pulp. The process includes mild chemical pulping, followed by oxygen pre-treatment and oxidative bleaching of the pulp in an extended duration pulping stage and then optionally further bleaching the pulp.

CROSS REFERENCE TO RELATED CASES

This patent application relates, in part, to the following co-pending United States patent applications:

- United States Patent Application Publication No. 2021/0079594, entitled High Efficiency Fiber Bleaching Process; and
- United States Patent Application Publication No. 2022/0213648, entitled Oxygen Treatment of High Kappa Fibers.

The foregoing applications are incorporated herein by reference in their entireties.

BACKGROUND

In chemical pulps, most of the lignin in the material is removed by aggressive chemical treatment in a digester. For high brightness chemical pulps, the fiber recovered from pulping is typically followed by aggressive alkali-oxygen treatment prior to bleaching or is bleached with chlorine or chlorine dioxide (ECF) compounds to further remove lignin as well as brighten the pulp. Chemical pulp is used for materials that need to be stronger, brighter or combined with mechanical pulps to give a product different characteristics. The Kraft process is the dominant chemical pulping method, with the Sulfite process second. For Kraft pulping procedures see U.S. Pat. No. 4,869,783, discussed below. See U.S. Pat. No. 4,295,929 to Leithem for exemplary pulping conditions for a Sulphite process as well as United States Patent Application Publication No. 20020129912 of Reinhard et al.

Overall, conventional processes for preparing high brightness chemical pulps generally exhibit much lower yields than mechanical pulps including thermomechanical pulps (TMP) and chemi-thermomechanical pulps (CTMP, typically treated with sulfite prior to grinding). Semichemical pulping is described in U.S. Pat. No. 4,116,758 to Ford et al. as well as U.S. Pat. No. 3,811,995 to Ringley and U.S. Pat. No. 9,556,558 to Pylkkanen et al. Typically mechanical pulps are made at yields of 90% or more; chemi-mechanical pulps are made at yields of 80-95%; semichemical pulps are made at yields of 60-80% and chemical pulps are made at yields of less than 60%.

Efforts to improve yields in chemical pulp manufacture have been made, frequently by trying to make initial manufacturing steps more efficient in removing lignin. One method, for example, is by pre-treating wood chips prior to feeding them to a digester as is seen in U.S. Pat. No. 4,869,783 to Prusas et al. The process disclosed in the '783 patent includes the steps of: partially defiberizing wood chips such that the fibers in said chips are substantially separated from one another but sufficient interfiber bonding points are maintained within said chip to preserve chip integrity and thereby provide a chip having an open porous fibrous network; the wood chips being partially defiberized by passing said chips through a screw press having a compression ratio of about 3/1 to 5/1 under a substantial back pressure; directly feeding said partially defiberized chips to a digester; subjecting said partially defiberized chips to chemical pulping at elevated temperature and pressure to provide a pulp having a Kappa value of about 45 to 70; then further delignifying said pulp by reacting said pulp with oxygen in the presence of caustic; followed by bleaching the pulp. According to the disclosure, the pulp is delignified to have a Kappa number of from 15 to 25 prior to bleaching. See Col 3, lines 36-43.

Another approach to improving yields is seen in U.S. Pat. No. 10,000,889 to Hart et al. wherein chemically pulped fiber is screened to provide an accepts portion and a rejects portion. The rejects portion is mechanically pulped by a CTMP process (alkaline peroxide mechanical pulping, known as APMP) and used separately for papermaking or blended back with the accepts portion to make a hybrid product. The hybrid product is reported useful for packaging applications, where brightness is not critical.

Generally speaking, there are numerous methods for delignifying and bleaching virgin pulps and/or secondary pulps known in the art, regardless of the pulping method. The following references are representative.

U.S. Pat. No. 3,655,505 to Yorston et al. discloses a two-stage process for bleaching cellulosic pulp, including a first stage chlorine bleaching step followed by a peroxygen bleaching stage.

U.S. Pat. No. 4,938,842 to Whiting et al. discloses a process for bleaching cellulosic pulp at high consistency with hydrogen or sodium peroxide. The bleaching liquor is mixed with the pulp at low consistency, which is then thickened and bleached for a few hours, typically for 2 hours at a temperature of about 50° C. Col. 4 mentions prophetically conditions of consistency in the range of 20-70%, a temperature of from 10-90° C. for retention times of 1 minute to 24 hours, although actual retention times are lower.

U.S. Pat. No. 5,217,575 to Backlund discloses a process for oxygen bleaching cellulosic pulp using 2 vertical towers at superatmospheric pressure in the range of about 0.5 Mpa (72.5 psig). The temperature in each tower is from about 75° C. to about 105° C. for retention times of 15 minutes to 45 minutes in the towers.

United States Patent Application Publication No. US2008/0087390 of Lee et al. discloses a method of bleaching cellulosic pulp, including recycle pulp, comprising an activating step, an alkaline peroxide step and a reductive bleaching step. Typical conditions for each step are seen in Table 12, page 16. Alkaline peroxide bleaching may be carried out in the presence of oxygen (an "EOP" stage) at temperatures of 170° F. (77° C.) or so and the reductive bleaching step with hydrosulfite (a "Y" stage) may be carried out at similar temperatures. Retention times for each step are usually on the order of an hour or less.

United States Patent Application Publication No. US2009/0242152 of Vilpponen et al. discloses a two-stage bleaching process, including a chlorine dioxide ("D") bleaching step, followed by an EOP bleaching stage, in many respects similar to the US2008/0087390 publication noted above.

Additional multi-stage bleaching processes for cellulosic pulp are disclosed in United States Patent Application Publication No. US2012/0067532 of Lee et al. The methods used alkaline hydroxide in combination with oxygen and peroxide in the initial bleaching stages, followed by treatment with a peroxide activating agent, followed by a final reductive bleaching stage.

United States Patent Application Publication No. US2013/0203699 of Nonni et al. discloses a method of bleaching cellulose pulp, including chemically modifying the fibers during the bleaching process by oxidizing the pulp under acidic conditions with a peroxide under acidic conditions with a catalyst during bleaching. The finished modified fibers are reported to be useful to inhibit the growth of microbes in finished paper products.

U.S. Pat. No. 5,011,572 to Parthasarathy et al. describes a process for a two-stage oxygen delignification (i.e. with molecular oxygen) of chemical pulp in which 0.01% to 1% hydrogen peroxide is incorporated into the first and, optionally the second stage. The invention is particularly suitable when the pulp is subsequently bleached with at least one chlorine dioxide stage and at least one hydrogen peroxide stage.

U.S. Pat. No. 5,211,809 to Naddeo et al. relates to oxygen color stripping of secondary fibers. Color from dyes is removed from secondary pulps with non-chlorine based bleaching agents in treating sequences using oxygen with combinations of peroxide, ozone, and/or hydrosulfite at controlled pH conditions (less than 8 or greater than 10). According to the disclosure, acid treatment prior to bleaching steps improves color removal and protects fibers from damage at more severe bleaching conditions.

U.S. Pat. No. 5,486,268 to Nguyen relates to delignification of pulp derived from old corrugated containers (OCC) which has Kappa numbers on the order of 70 or 80 prior to treatment. The OCC are recycled employing oxygen delignification in the presence of an alkaline material to produce a recycled pulp of lower kappa number, while maintaining adequate strength in the pulp. The recycling process preferably employs an acid pretreatment in combination with the oxygen delignification, and exposure of the waste product to the alkaline material is preferably controlled so that at any point in the delignification the waste product is exposed to not more than 50%, by dry weight, of the alkaline material based on the weight of residual lignin in the waste paper product. The treated pulp has Kappa numbers of from 15 to 35 according to the reference.

U.S. Pat. No. 5,958,179 to Gehr et al. discloses a process for increasing brightness of pulp derived from printed waste-paper. The process may include using paper fiber pulp, derived in part from printed waste paper, into a suspension with water. The suspension may be mixed with bleaching aids and bleaching chemicals, including molecular oxygen. Pre-treatment includes intensely mechanically treating the pulp, e.g., at least 20 kWh/ton, prior to bleaching the pulp suspension with or without bleaching chemicals. See Col 7, lines 3-32.

U.S. Pat. No. 5,997,689 to Bokstrom is directed to a method of bleaching secondary fibers. A secondary fiber pulp is first slushed and then transferred at a consistency of 20-40% to a disperser. In the disperser, the secondary fiber pulp is mechanically treated and mixed so that ink particles in the secondary fiber pulp are dispersed throughout the secondary fiber pulp. While the secondary fiber pulp is being treated and mixed in the disperser, oxygen is delivered to the disperser so as to distribute the oxygen within the secondary fiber pulp which is then delivered to a bleaching tower.

U.S. Pat. No. 6,059,927 to Wan et al. describes a method for reducing brightness reversion and yellowness (b*) of bleached mechanical wood pulps. The pulp is digested in an aqueous formaldehyde solution containing carbonate, preferably in an amount up to 30% by weight of pulp. Paper made from the digested pulp can be further improved by treating with a reversion inhibitor such as a polyethylene glycol bisthiol.

U.S. Pat. No. 6,632,328 to Wan et al. is directed to a method for bleaching unbleached softwood or hardwood pulps using hydrogen peroxide without added alkali for activation. The aqueous hydrogen peroxide solution contains an alkaline earth metal carbonate, preferably magnesium carbonate and can be used at elevated temperatures. Bleached hardwood or softwood mechanical pulps with high brightness, low yellowness (b*) and reduced reversion properties are reported.

U.S. Pat. No. 10,000,890 to Nonni et al. relates to fiber with improved ant-yellowing. Col. 6 lines 7-32 refers to oxygen de-lignification of the pulp after it has been cooked to a Kappa number from about 17 to 21; bleaching is carried out after the Kappa numbers reach 8 or less.

Mechanical pulps such as TMP, CTMP and semichemical pulps prepared by conventional means are not readily bleachable to high brightness by existing techniques due to their high lignin content. As opposed to chemical pulping, mechanical pulping processes do not generate dark color bodies on the lignin. The mostly intact lignin is brightened along with the fiber in both the mechanical separation step and post separation bleaching. This results in the high yield and high brightness of the pulp. However, bleaching mechanical pulp is not capable of totally decolorizing the lignin. The process has a maximum brightness lower than the Kraft Process. The brightness ceiling is dependent on the wood species with softwoods generally no higher than 80 ISO brightness and hardwoods achieving somewhat higher brightness. So also, mechanical pulps are generally of high stiffness and lower strength and are undesirable for many products.

SUMMARY OF INVENTION

There is provided in accordance with the present invention a method of producing high brightness, chemical cellulosic pulp at high yields which closely mimics the mechanical properties and brightness of low yield virgin chemical pulp.

The inventive process includes: (a) chemically pulping wood chips to separate lignin and liberate cellulosic fibers from the wood chips to generate a cellulosic pulp; (b) washing and screening the pulp of step (a); (c) pre-treating the washed pulp with oxygen; (d) optionally washing the treated pulp of step (c); (e) bleaching the pre-treated pulp in an extended duration oxidative bleaching stage; (f) optionally washing the bleached pulp of step (e); and (g) optionally further oxidatively or reductively bleaching the bleached pulp in a shorter duration bleaching stage, wherein the bleached pulp is produced at a yield of greater than 60% based on the weight of the pulped wood chips (dry basis).

The invention also is directed to cellulosic pulps so made.

Typically, the process of this invention is practiced in connection with the following steps:

1. Conventional wood handling, debarking, cleaning and chipping;
2. Kraft, sulphite, alkaline or similar chemical cooking to separate enough lignin from the fibers to liberate the fiber and generate a fiber pulp;

3. Brown stock washing and screening;
4. A mild oxygen pre-treatment or activation step. The process conditions selected to open up the lignin to bleaching reactions without excessive removal of the lignin;
5. Chemical or displacement washing to remove excess bleaching chemicals and residuals;
6. The high lignin oxygen treated pulp would then preferably be bleached at a low temperature, long duration with peroxide (a "Psv" process) for 24-48 hours or longer. This step would substantially brighten the pulp without significant lignin loss;
7. Chemical or displacement washing to remove excess bleaching chemicals and residuals;
8. A third stage of oxidative and/or reductive bleaching is performed. The step could be done with oxygen, hydrogen peroxide, an alkali source, a peroxygen, ozone, a reductive compound, an acid source or combinations of these chemicals and conditions. Chlorine dioxide or other traditional chemicals could be used as long as the conditions were set to brighten the pulp with minimal yield loss;
9. Chemical or displacement washing to remove excess bleaching chemicals and residuals;
10. A $4^{th}$ stage of bleaching using any of the chemicals in step 8 above;
11. Chemical or displacement washing to remove excess bleaching chemicals and residuals; and
12. The pulp can optionally be subjected to a $5^{th}$ stage of bleaching depending on the desired final brightness and raw material.

It should be appreciated that there is a large number of permutations and variations of the basic concept at each step. For example, the initial cooking conditions might be beneficially modified to reduce the lignin darkening and increase the ultimate yield. A chelation ("Q") stage may be incorporated in several steps in the bleaching sequence. The chemical addition at each stage can be modified if appropriate based on the raw material and final product attributes desired.

Further details and advantages will become apparent from the description which follows.

DETAILED DESCRIPTION

The invention is described in detail below for purposes of illustration only. The invention is defined in the appended claims. Unless otherwise indicated, terminology used herein is given its ordinary meaning consistent with the exemplary definitions set forth immediately below; g, or G refers to grams, MT means metric ton, percents, ppm and like terminology relates to weight percent, parts per million by weight unless otherwise indicated and so forth. Unless otherwise indicated, or readily apparent, chemical cooking and bleaching stages are carried out in aqueous media as will be appreciated by one skilled in the art.

An alkaline agent means a compound used to adjust the pH of the bleaching liquor to relatively high values. Hydroxides such as caustic, sodium hydroxide are preferred.

Bleaching temperature and like terminology refers to the temperature maintained in a bleaching stage or a vessel over the retention time of bleaching, and may be referred to as retention temperature.

"ISO Brightness" or simply brightness as used herein refers to the measured brightness of the pulp made into handsheets in accordance with TAPPI Test Method T 525 om-17 or equivalent, with C-illumination. Diffuse reflectance is measured in the wavelength range of 400-520 nm with an effective wavelength of 457 nm by using a suitable filter set or an equivalent device for modifying the spectral response and an instrument having diffuse illumination and perpendicular observation geometry. The measurements are made in terms of absolute reflectance factors. Brightness testing is done on handsheets using a MacBeth Ci5 instrument. Brightness gain is expressed as a percentage relative to the brightness of the pulp prior to bleaching.

Chemical pulping, chemical cooking and like terminology refers to separating cellulosic fiber pulp from wood or other plant-based materials from which non-cellulose components are removed by chemical pulping without substantial mechanical post-treatment; preferably with no mechanical grinding at all. In case of chemical pulping processes such as the Sulfite or Sulfate (Kraft) process, primarily the lignin components and the hemi-cellulose components are dissolved from the wood to varying degrees depending on the desired end product. The Kraft Process involves treatment of wood chips with a hot mixture of water, sodium hydroxide (NaOH), and sodium sulfide ($Na_2S$), known as white liquor, that breaks the bonds that link lignin, hemicellulose, and cellulose. The Sulfite process produces wood pulp by treating wood chips with solutions of sulfite and bisulfite ions. These chemicals cleave the bonds between the cellulose and lignin components of the lignocellulose. A variety of sulfite/bisulfite salts are used, including sodium (Nat), calcium ($Ca_2^+$), potassium ($K^+$), magnesium ($Mg_2^+$), and ammonium ($NH_4^+$). The lignin is converted to lignosulfonates, which are soluble and can be separated from the cellulose fibers.

"Chemical wash", "wash", "displacement wash" or like terminology refers to a washing step with water to remove chemicals and bleaching residues from the pulp. A washing step is usually advisable following a peroxy bleaching step, before a subsequent stage, and is usually required between peroxy bleaching steps to optimize results. When implementing the present invention, a wash may be provided between pre-treatment and bleaching stages and between bleaching stages unless otherwise indicated.

"Consisting essentially of" and like terminology with respect to compositions refers to the recited components and excludes other ingredients which would substantially change the basic and novel characteristics of the composition, article or process. Unless otherwise indicated or readily apparent, a composition or article consists essentially of the recited or listed components when the composition or article includes 90% or more by weight of the recited or listed components, optionally on a dry basis, that is, without water. The terminology thus excludes more than 10% unrecited components. In connection with methods of bleaching or oxygen treating of pulp, the terminology consisting essentially of recited steps excludes additional bleaching or oxidative treatments, but does not exclude washing steps interposed between bleaching or oxygen treatment steps.

Consistency, % C or like terminology refers to percent solids of a pulp slurry calculated on a dry basis. A slurry having 80 percent water and 20 percent dry pulp has a consistency of 20 percent. Unless otherwise indicated, dry pulp, dried pulp and like terminology means oven dry pulp, which may have up to a few percent water.

A Kappa number is determined in accordance with TAPPI Method T236-0M-99 or equivalent. The Kappa number is the volume (in millimeters) of 0.1N potassium permanganate solution consumed by one gram of moisture-free pulp. The results are corrected to 50% consumption of the permanganate added. Kappa numbers are commonly used to determine lignin content and used to determine bleachability of pulp.

"Oxidative" bleaching and like terminology refers to bleaching or oxidative brightening operations with oxidative beaching agents such as oxygen, ozone, peroxy compounds, chlorine, chlorine dioxide, hypochlorite; for example P stages, EOP stages, Paa stages and so forth.

"Percent on pulp" "OP" and like terminology refers to the weight ratio of a hydrogen peroxide/dried pulp×100% in a charge to a bleaching stage.

Percent on pulp, OP, "percent applied to pulp" and the like may likewise be expressed for hydrogen peroxide and other peroxy bleaching agents as kg-moles/metric ton of dried pulp, it being noted that 1% OP or 1% Percent consumed on pulp corresponds to 0.295 kg-moles bleaching agent/metric ton of dried pulp.

A bleaching or delignification "stage" refers to bleaching or otherwise treating pulp in a vessel under a specified set of conditions. Subsequent stages may be undertaken in the same vessel for batch or semi-batch processes and in downstream vessels for continuous processes.

"Peroxy compound" and like terminology refers to compounds having a peroxo group. Typically one employs hydrogen peroxide in the bleaching method of the invention; however, one may utilize other peroxy compounds as a bleaching agent or for delignification if so desired. Other suitable peroxy bleaching compounds include peroxyacetic acid, peroxyformic acid, potassium peroxymonosulfate, dimethyldioxirane, peroxymonophosphoric acid and so forth.

A "reductive bleaching agent" refers to a reducing agent used to bleach pulp. Commercial systems may employ a mix of sodium borohydride and sodium bisulfite that form sodium hydrosulfite either in situ with the pulp or in a mixing step prior to addition to a reductive bleaching stage. Alternatively, sodium hydrosulfite as such may be used as available. These bleaching agents and equivalents are referred to as hydrosulfite bleaching agents. Additional reductive bleaching agents which may be used include formamidine sulfinic acid (FAS) and hydroxymethane sulfinic acid (HAS), as well as dithionites. See U.S. Pat. No. 4,871,423 to Grimsley et al. When a reductive bleaching agent is used in a bleaching stage, the stage is referred to as a reductive bleaching stage, a Y stage or with like terminology.

"Retention time" and like terminology refers to the duration of bleaching under a specified set of conditions in a bleaching stage. Temperatures, retention temperatures and the like refer to temperatures maintained during the retention time in a bleaching vessel.

Yield is calculated as the dry weight of the recovered pulp divided by the dry weight of the wood chips processed times 100%. Lignin reduction (%) is calculated as: (the percentage of lignin in the dry wood chips less the percentage of lignin in the dry finished pulp) divided by the percentage of lignin in the dry wood chips times 100%. Thus, a process fed with 100 pounds of wood chips yielding 70 pounds of finished pulp has a yield of 70%. A process where the percentage of lignin in the wood fed is 20% and the percentage of lignin in the finished pulp is 8% has a lignin reduction of 60%.

Conventional pulp bleaching stages are commonly referred to as Y stages, EO stages, D stages, EOP stages, Paa stages or P stages.

A "Y" stage refers to a reductive bleaching stage utilizing a reductive bleaching agent.

An "EO" stage refers to an alkaline, oxygen based bleaching stage carried out under oxygen pressure of from 0.25 to 1 Mpa in most cases.

An "EOP" stage refers to an EO stage with a peroxy bleaching agent present.

A "P" stage refers to a conventional alkaline peroxy bleaching stage, usually with hydrogen peroxide, referred to as peroxide. Representative operating parameters for a P stage appear in Table 1.

TABLE 1

Operating Parameters for P Stage bleaching

| Peroxide % OP | NaOH % OP | Temperature ° F./° C. | Retention Minutes |
|---|---|---|---|
| 1% | 1% | 185/85 | 60 |
| 3% | 3% | 185/85 | 60 |

A Paa stage refers to treatment of the pulp with a peroxyacid or related compound which is operative to remove lignin and optionally, to bleach the pulp. See U.S. Pat. No. 6,007,678 to Linsten et al.

A D stage refers to a chlorine dioxide bleaching stage.

The processes of the invention may include multi-stage shorter duration bleaching protocols with sequential steps, for example a P/Y regimen which indicates a P stage followed by a Y stage and so forth.

Each of the conventional processes noted above are of shorter duration than the extended duration oxidative bleaching stage described herein. Typically, conventional bleaching is carried out for a retention time of from about 5 minutes to about 3.5 hours, typically from 10 minutes to 2.5 hours of retention time and in many cases for a retention time of from 15 minutes to 1 hour. These processes are likewise carried out at relatively elevated temperatures, generally from 50° C. to about 150° C., with from 65° C. to about 125° C. being typical. Bleaching at over 100° C. requires a pressurized reactor, which involves high capital costs.

The oxygen pre-treatment stage of the present invention resembles an alkaline oxygen (EO) bleaching stage. Suitable conditions are for example, treating the pulp at 10-30% consistency for 10-200 minutes at 80 to 90 or 95° C. temperature and an oxygen pressure of 0.25 to 1 Mpa (36-145 PSIG). The oxygen charged amounts to approximately 1% oxygen on oven dry (OD) fiber on a weight basis; the actual consumption of oxygen is significantly less. Specific conditions may include 0 bleaching for 60 minutes at 80-87.5° C. temperature at 60 PSIG (0.414 MPa) charge of oxygen at the beginning of the retention and the oxygen vented and recharged at 15 minutes. 0 bleaching is carried out, for example, with 3-9% NaOH OP in the process.

In the oxygen pre-treatment of the pulp in accordance with the present invention, the alkali dose is selected to provide brightening without excessive delignification, that is a lignin or Kappa reduction of less than 50% based on the Kappa number prior to oxygen pretreatment. For example, if the initial Kappa number of the pulp is 120 before pre-treatment, the Kappa number after oxygen pre-treatment is greater than 60. The lignin content in percent is roughly 0.15 times the Kappa number. In various embodiments, the lignin reduction is less than 40%, 35%, 30%, 25% or 20% based on the lignin content prior to oxygen pretreatment. This limited reduction in lignin contrasts the invention with conventional oxygen delignification, where the lignin loss or Kappa Reduction is typically well in excess of 50%.

Suitable conditions for pre-treating the pulp with oxygen and caustic prior to further bleaching appear in Table 2 below.

TABLE 2

| O Stage Pretreatment | | | |
|---|---|---|---|
| Parameter | General | Typical | Preferred |
| pH | 8-13 | 8.5-12.5 | 9.5-12.5 |
| % NaOH OP | 1-15 | 3-10 | 3-6 |
| T, ° C. | 60-120 | 75-115 | 80-115 |
| $O_2$ P, PSIG | 36-145 | 75-130 | 80-120 |
| $O_2$ P, MPa | 0.25-1 | 0.52-0.9 | 0.55-0.83 |
| Consistency, % | 3-30 | 5-20 | 6-15 |
| Residence Time (min) | 30-150 | 65-130 | 70-115 |

Acid Chelation (Q Stage)

Acid chelation may be incorporated into the inventive process for the purpose of removing counterions, particularly transition metals which reduce the stability of $H_2O_2$.

Extended Duration Oxidative Bleaching Also Referred to as Peroxide Sous Vide ($P_{sv}$)

Extended duration oxidative bleaching, or $P_{sv}$ is a new type of bleaching stage developed by Applicant. $P_{sv}$ literally means "under vacuum" but in actual application it represents a low temperature, long cook stage. This technology can be retrofit for little cost to essentially achieve high brightness at low operating cost. Low temperature, long retention produced a brightness that was 2-3 points lower than other options, but has advantages of lower energy costs and minimal additional capital investment. $P_{sv}$ can whiten colored fibers that conventional high temperature applications do not. What is likely occurring is the longer residence time is allowing the slower reaction pathways to be completed rendering the slow to oxidize moieties to be brightened.

A preferred set of ranges for operating parameters for extended duration oxidative bleaching include:

Temperature: From 110-135° F. (43-57° C.), typically about 125° F. (52° C.);

Retention time: From 6-200 hours, typically about 15 hours in many cases;

pH: From 9.5-12.5, typically from 10-11;

Consistency: From 10-30%, typically about 15%.

Exemplary High Yield Chemical Pulping and Bleaching

1. Wood Chips are digested in a Kraft type process with a hot mixture of water, sodium hydroxide (NaOH), and sodium sulfide ($Na_2S$) (white liquor) that breaks the bonds that link lignin, hemicellulose, and cellulose;
2. The resulting brown stock is washed and screened to yield cellulosic pulp;
3. A mild oxygen pre-treatment or activation step is carried out under the following conditions:

| Parameter | General |
|---|---|
| pH | 8-13 |
| % NaOH OP | 1-15 |
| T, ° C. | 60-120 |
| $O_2$ P, PSIG | 36-145 |
| $O_2$ P, MPa | 0.25-1 |
| Consistency, % | 3-30 |
| Residence Time (min) | 30-150 |
| Kappa Reduction | 5-35 |
| ISO Increase | 0 or less-15 |

The process conditions are selected to open up the lignin to bleaching reactions without excessive removal of the lignin;

4. Chemical or displacement washing to remove excess bleaching chemicals and residuals;
5. The washed and bleached pulp is bleached at a low temperature, long duration with peroxide (a "Psv") process for 24-48 hours or longer. This step substantially brightens the pulp without significant lignin loss, preferably under the following conditions at a consistency of from 10-30%:
   Temperature: From 110-135° F. (43-57° C.), typically about 125° F. (52° C.);
   pH: From 9.5-12.5, typically from 10-11;
6. Chemical or displacement washing is then performed to remove excess bleaching chemicals and residuals;
7. A third stage of oxidative or reductive bleaching of shorter duration is then performed. This step could be done with oxygen, hydrogen peroxide, an alkali source, a peroxygen, ozone, a reductive compound, an acid source or combinations of these chemicals and conditions. Chlorine dioxide or other traditional chemicals could be used as long as the conditions were set to brighten the pulp with minimal yield loss. The bleaching at this stage in the process is selected from a P stage, an EOP stage, an EO stage, a Paa stage, a D stage or a Y stage.
8. Chemical or displacement washing to remove excess bleaching chemicals and residuals;
9. A $4^{th}$ stage of bleaching using any of the chemicals in step 7 above;
10. Chemical or displacement washing to remove excess bleaching chemicals and residuals; and
11. The pulp can optionally be subjected to a $5^{th}$ stage of bleaching depending on the desired final brightness and raw material and yield requirements.

Q stage(s) are incorporated into the process as necessary or desirable to remove metal ions and the like.

Exemplary Embodiments of the Invention

The invention may thus be practiced in various embodiments, wherein Embodiment No. 1 is a method of producing high yield chemical cellulosic pulp comprising:

(a) chemically pulping wood chips to separate lignin and liberate cellulosic fibers from the wood chips to generate a cellulosic pulp;
(b) washing and screening the pulp of step (a);
(c) pre-treating the washed pulp with oxygen;
(d) optionally washing the treated pulp of step (c);
(e) bleaching the pre-treated pulp in an extended duration oxidative bleaching stage;
(f) optionally washing the bleached pulp of step (e); and
(g) optionally further oxidatively or reductively bleaching the bleached pulp in a shorter duration bleaching stage, wherein the bleached pulp is produced at a yield of greater than 60% based on the weight of the pulped wood chips (dry basis).

Embodiment No. 2 is the method of producing high yield chemical cellulosic pulp according to Embodiment No. 1, wherein the bleached pulp is produced at a yield of greater than 65% based on the weight of the pulped wood chips (dry basis).

Embodiment No. 3 is the method of producing high yield chemical cellulosic pulp according to Embodiment No. 1, wherein the bleached pulp is produced at a yield of greater than 70% based on the weight of the pulped wood chips (dry basis).

Embodiment No. 4 is the method of producing high yield chemical cellulosic pulp according to Embodiment No. 1, wherein the bleached pulp is produced at a yield of greater than 75% based on the weight of the pulped wood chips (dry basis).

Embodiment No. 5 is the method of producing high yield chemical cellulosic pulp according to Embodiment No. 1, wherein the bleached pulp is produced at a yield of 80% or more based on the weight of the pulped wood chips (dry basis).

Embodiment No. 6 is the method of producing high yield chemical cellulosic pulp according to any of the foregoing Embodiments, wherein bleached pulp produced by the process has an ISO Brightness of 70 or more.

Embodiment No. 7 is the method of producing high yield chemical cellulosic pulp according to any of the foregoing Embodiments, wherein bleached pulp produced by the process has an ISO Brightness of 75 or more.

Embodiment No. 8 is the method of producing high yield chemical cellulosic pulp according to any of the foregoing Embodiments, wherein bleached pulp produced by the process has an ISO Brightness of 77.5 or more.

Embodiment No. 9 is the method of producing high yield chemical cellulosic pulp according to any of the foregoing Embodiments, wherein bleached pulp produced by the process has an ISO Brightness of 80 or more.

Embodiment No. 10 is the method of producing high yield chemical cellulosic pulp according to any of the foregoing Embodiments, wherein bleached pulp produced by the process has an ISO Brightness of 85 or more.

Embodiment No. 11 is the method of producing high yield chemical cellulosic pulp according to any of the foregoing Embodiments, wherein the process removes less than 75% of the lignin present in the wood chips.

Embodiment No. 12 is the method of producing high yield chemical cellulosic pulp according to any of the foregoing Embodiments, wherein the process removes less than 70% of the lignin present in the wood chips.

Embodiment No. 13 is the method of producing high yield chemical cellulosic pulp according to any of the foregoing Embodiments, wherein the process removes less than 60% of the lignin present in the wood chips.

Embodiment No. 14 is the method of producing high yield chemical cellulosic pulp according to any of the foregoing Embodiments, wherein the process removes less than 50% of the lignin present in the wood chips.

Embodiment No. 15 is the method of producing high yield chemical cellulosic pulp according to any of the foregoing Embodiments, wherein the process removes less than 40% of the lignin present in the wood chips.

Embodiment No. 16 is the method of producing high yield chemical cellulosic pulp according to any of the foregoing Embodiments, wherein the process removes less than 30% of the lignin present in the wood chips.

Embodiment No. 17 is the method of producing high yield chemical cellulosic pulp according to any of the foregoing Embodiments, wherein the process removes less than 20% of the lignin present in the wood chips.

Embodiment No. 18 is the method of producing high yield chemical cellulosic pulp according to any of the foregoing Embodiments, wherein the pulp produced has a Kappa number higher than 15.

Embodiment No. 19 is the method of producing high yield chemical cellulosic pulp according to any of the foregoing Embodiments, wherein the pulp produced has a Kappa number higher than 30.

Embodiment No. 20 is the method of producing high yield chemical cellulosic pulp according to any of the foregoing Embodiments, wherein the pulp produced has a Kappa number higher than 40.

Embodiment No. 21 is the method of producing high yield chemical cellulosic pulp according to any of the foregoing Embodiments, wherein the pulp produced has a Kappa number higher than 50.

Embodiment No. 22 is the method of producing high yield chemical cellulosic pulp according to any of the foregoing Embodiments, wherein the pulp produced has a Kappa number from 15 to 65.

Embodiment No. 23 is the method of producing high yield chemical cellulosic pulp according to any of the foregoing Embodiments, wherein the pulp produced has a Kappa number from 20 to 60.

Embodiment No. 24 is the method of producing high yield chemical cellulosic pulp according to any of the foregoing claims, wherein the pulp produced has a Kappa number from 30 to 60.

Embodiment No. 25 is the method of producing high yield chemical cellulosic pulp according to any of the foregoing Embodiments, wherein the wood chips are chemically pulped in a Kraft Process or a Sulphite Process.

Embodiment No. 26 is the method of producing high yield chemical cellulosic pulp according to Embodiment 25, wherein the wood chips are chemically pulped in a Kraft Process.

Embodiment No. 27 is the method of producing high yield chemical cellulosic pulp according to any of the foregoing Embodiments, wherein the step of pre-treating the washed pulp with oxygen is carried out at an oxygen pressure of from 0.25-1 MPa.

Embodiment No. 28 is the method of producing high yield chemical cellulosic pulp according to any of the foregoing Embodiments, wherein the step of pre-treating the washed pulp with oxygen is carried out in the presence of an alkaline agent.

Embodiment No. 29 is the method of producing high yield chemical cellulosic pulp according to any of the foregoing Embodiments, wherein the step of pre-treating the washed pulp with oxygen is carried out at a pH of from 8 to 13.

Embodiment No. 30 is the method of producing high yield chemical cellulosic pulp according to any of the foregoing Embodiments, wherein the step of pre-treating the washed pulp with oxygen is carried out for a residence time in a bleaching vessel of from 30 to 150 minutes.

Embodiment No. 31 is the method of producing high yield chemical cellulosic pulp according to any of the foregoing Embodiments, wherein the step of pre-treating the washed pulp with oxygen is carried out while applying from 1% to 15% NaOH to the washed pulp based on the dry weight of the washed pulp.

Embodiment No. 32 is the method of producing high yield chemical cellulosic pulp according to any of the foregoing Embodiments, wherein the step of bleaching the pre-treated pulp in an extended duration oxidative bleaching stage comprises: (i) providing the pre-treated pulp in aqueous form to the extended duration bleaching stage at a consistency of from 10% to 30% along with a peroxy bleaching agent and an alkaline agent effective to adjust pH of the charge to 9.5 to 12.5; (ii) bleaching the pulp in a bleaching vessel while maintaining an extended duration bleaching temperature of from 110° F. (43° C.) to 135° F. (57° C.) and a pH of the charge from 9.5 to 12.5 for a bleaching retention time in the extended duration bleaching stage for at least 6 hours.

Embodiment No. 33 is the method of producing high yield chemical cellulosic pulp according to Embodiment No. 32, comprising bleaching the pulp in the bleaching vessel while maintaining an extended duration bleaching temperature of from 110° F. (43° C.) to 135° F. (57° C.) and a pH of the charge from 9.5 to 12.5 for a bleaching retention time in the extended duration bleaching stage for at least 12 hours.

Embodiment No. 34 is the method of producing high yield chemical cellulosic pulp according to Embodiment No. 32, comprising bleaching the pulp in the bleaching vessel while maintaining an extended duration bleaching temperature of from 110° F. (43° C.) to 135° F. (57° C.) and a pH of the charge from 9.5 to 12.5 for a bleaching retention time in the extended duration bleaching stage for at least 24 hours.

Embodiment No. 35 is the method of producing high yield chemical cellulosic pulp according to Embodiment No. 32, comprising bleaching the pulp in the bleaching vessel while maintaining an extended duration bleaching temperature of from 110° F. (43° C.) to 135° F. (57° C.) and a pH of the charge from 9.5 to 12.5 for a bleaching retention time in the extended duration bleaching stage for at least 48 hours.

Embodiment No. 36 is the method of producing high yield chemical cellulosic pulp according to Embodiment No. 32, comprising bleaching the pulp in the bleaching vessel while maintaining an extended duration bleaching temperature of from 110° F. (43° C.) to 135° F. (57° C.) and a pH of the charge from 9.5 to 12.5 for a bleaching retention time in the extended duration bleaching stage for at least 96 hours.

Embodiment No. 37 is the method of producing high yield chemical cellulosic pulp according to any of Embodiment Nos. 32 to 36, wherein the extended duration bleaching temperature is from 118.4° F. (48° C.) to 131° F. (55° C.).

Embodiment No. 38 is the method of producing high yield chemical cellulosic pulp according to any of Embodiment Nos. 32 to 37, wherein the extended duration bleaching stage is carried out at a pH of from 10 to 11.

Embodiment No. 39 is the method of producing high yield chemical cellulosic pulp according to any of Embodiment Nos. 32 to 38, wherein the extended duration bleaching stage is carried out with a peroxy bleaching agent applied to the cellulosic pulp in an amount of from 0.1 kg-moles bleaching agent/metric ton of dried pulp to 2.4 kg-moles bleaching agent/metric ton of dried pulp.

Embodiment No. 40 is the method of producing high yield chemical cellulosic pulp according to any of Embodiment Nos. 32 to 39, wherein the peroxy bleaching agent utilized in the extended duration bleaching stage is hydrogen peroxide applied to the fiber in an amount of from 0.35% on dried pulp to 4% on dried pulp.

Embodiment No. 41 is the method of producing high yield chemical cellulosic pulp according to any of the foregoing Embodiments, wherein the method comprises one or more Q stages.

Embodiment No. 42 is the method of producing high yield chemical cellulosic pulp according to any of the foregoing Embodiments, comprising bleaching the pulp in a shorter duration bleaching stage following bleaching in the extended duration oxidative bleaching stage.

Embodiment No. 43 is the method of producing high yield chemical cellulosic pulp according to Embodiment No. 42, wherein the shorter duration bleaching stage comprises a bleaching stage selected from a P stage, an EOP stage, an EO stage, a Paa stage, a D stage or a Y stage.

Embodiment No. 44 is the method of producing high yield chemical cellulosic pulp according to Embodiment No. 42, comprising bleaching the pulp in at least two shorter duration bleaching stages following bleaching in the extended duration oxidative bleaching stage, wherein the shorter duration bleaching stages are selected from P stages, EOP stages, EO stages, Paa stages, D stages or Y stages.

Embodiment No. 45 is a high brightness, high yield cellulosic pulp produced by the method according to any of the foregoing Embodiments.

While the invention has been described in detail, modifications within the spirit and scope of the invention will be readily apparent to those of skill in the art. Such modifications are also to be considered as part of the present invention. In view of the foregoing discussion, relevant knowledge in the art, the related copending cases and references discussed above in connection with the foregoing description including the Cross Reference to Related Applications, the Detailed Description and Background of the Invention, the disclosures of which are all incorporated herein by reference, further description is deemed unnecessary. In addition, it should be understood from the foregoing discussion that aspects of the invention and portions of various embodiments may be combined or interchanged either in whole or in part. Furthermore, those of ordinary skill in the art will appreciate that the foregoing description is by way of example only, and is not intended to limit the invention.

The invention claimed is:

1. A method of producing high yield chemical cellulosic pulp comprising:

(a) chemically pulping wood chips in a Kraft Process to separate lignin and liberate cellulosic fibers from the wood chips to generate a cellulosic pulp;

(b) washing and screening the cellulosic pulp of step (a) to generate a washed pulp;

(c) pre-treating the washed pulp of step (b) with oxygen to generate a pre-treated pulp; and (d) bleaching the pre-treated pulp of step (c) in an extended duration oxidative bleaching stage in a bleaching vessel for a residence time of from 6 to 200 hours to generate a bleached pulp;

wherein the bleached pulp of step (d) is produced at a yield of from 60% to 80% based on the weight of the wood chips in step (a) (dry basis).

2. The method of producing high yield chemical cellulosic pulp according to claim 1, wherein the bleached pulp of step (d) is produced at a yield of from 65% to 80% based on the weight of the wood chips in step (a) (dry basis).

3. The method of producing high yield chemical cellulosic pulp according to claim 1, further comprising:

(e) oxidatively or reductively bleaching the bleached pulp of step (d) in a shorter duration bleaching stage in a bleaching vessel for a residence time of from 5 minutes to 3.5 hours, wherein the bleached pulp of step (e) is produced at a yield of from 60% to 75% based on the weight of the wood chips in step (a) (dry basis).

4. The method of producing high yield chemical cellulosic pulp according to claim 3, wherein the step (c) of pre-treating the washed pulp with oxygen reduces the kappa number of the resulting pre-treated pulp by less than 50% compared to the washed pulp of step (b).

5. The method of producing high yield chemical cellulosic pulp according to claim 4, wherein the step (d) of bleaching the pre-treated pulp in an extended duration oxidative bleaching stage is carried out in a bleaching vessel for a residence time of from 24 to 48 hours at a temperature of from 43° C. to 57° C.

6. The method of producing high yield chemical cellulosic pulp according to claim 5, wherein the step (e) of bleaching the bleached pulp in a shorter duration bleaching stage is carried out in a bleaching vessel for a residence time of from 10 minutes to 2.5 hours at a temperature of from 65° C. to 125° C.

7. The method of producing high yield chemical cellulosic pulp according to claim 3, wherein the step (d) of bleaching the pre-treated pulp in an extended duration oxidative bleaching stage is carried out in a bleaching vessel for a residence time of from 24 to 48 hours at a temperature of from 43° C. to 57° C.

8. The method of producing high yield chemical cellulosic pulp according to claim 7, wherein the step (e) of bleaching the bleached pulp in a shorter duration bleaching stage is carried out in a bleaching vessel for a residence time of from 10 minutes to 2.5 hours at a temperature of from 65° C. to 125° C.

9. The method of producing high yield chemical cellulosic pulp according to claim 1, wherein bleached pulp of step (d) has an ISO Brightness of 80 or more.

10. The method of producing high yield chemical cellulosic pulp according to claim 1, wherein the step (c) of pre-treating the washed pulp with oxygen is carried out at an oxygen pressure of from 0.25-1 MPa.

11. The method of producing high yield chemical cellulosic pulp according to claim 1, wherein the step (c) of pre-treating the washed pulp with oxygen is carried out in the presence of an alkaline agent.

12. The method of producing high yield chemical cellulosic pulp according to claim 11, wherein the step (c) of pre-treating the washed pulp with oxygen is carried out for a residence time in a bleaching vessel of from 30 to 150 minutes at a temperature from 60° C. to 120° C.

13. The method of producing high yield chemical cellulosic pulp according to claim 1, wherein the step (d) of bleaching the pre-treated pulp in an extended duration oxidative bleaching stage comprises: (i) providing the pre-treated pulp of step (c) in aqueous form to the extended duration bleaching stage at a consistency of from 10% to 30% along with a peroxy bleaching agent and an alkaline agent effective to adjust pH of the charge to 9.5 to 12.5; (ii) bleaching the pulp in a bleaching vessel while maintaining an extended duration bleaching temperature of from 110° F. (43° C.) to 135° F. (57° C.) and a pH of the charge from 9.5 to 12.5 for a bleaching retention time in the extended duration bleaching stage for at least 6 hours.

14. The method of producing high yield chemical cellulosic pulp according to claim 13, wherein the peroxy bleaching agent utilized in the extended duration bleaching stage of step (d) is hydrogen peroxide applied to the fiber in an amount of from 0.35% on dried pulp to 4% on dried pulp.

15. The method of producing high yield chemical cellulosic pulp according to claim 1, wherein the method comprises one or more Q stages.

16. The method of producing high yield chemical cellulosic pulp according to claim 1, wherein the step (c) of pre-treating the washed pulp with oxygen reduces the kappa number of the resulting pre-treated pulp by less than 50% compared to the washed pulp of step (b).

17. The method of producing high yield chemical cellulosic pulp according to claim 16, wherein the step (d) of bleaching the pre-treated pulp in an extended duration oxidative bleaching stage is carried out in a bleaching vessel for a residence time of from 24 to 48 hours at a temperature of from 43° C. to 57° C.

18. The method of producing high yield chemical cellulosic pulp according to claim 1, wherein the step (d) of bleaching the pre-treated pulp in an extended duration oxidative bleaching stage is carried out in a bleaching vessel for a residence time of from 24 to 48 hours at a temperature of from 43° C. to 57° C.

* * * * *